US010688361B2

(12) United States Patent
Cottam

(10) Patent No.: US 10,688,361 B2
(45) Date of Patent: Jun. 23, 2020

(54) BALL STRIKING SWING TRAINING AID

(71) Applicant: JINTAP PTY LTD, East Melbourne, Victoria (AU)

(72) Inventor: Peter Cottam, Highton (AU)

(73) Assignee: JINTAP PTY LTD, East Melbourne, Victoria (AU)

( * ) Notice: Subject to any disclaimer, the term of this patent is extended or adjusted under 35 U.S.C. 154(b) by 0 days.

(21) Appl. No.: 15/769,484

(22) PCT Filed: Jul. 15, 2016

(86) PCT No.: PCT/AU2016/000253
§ 371 (c)(1),
(2) Date: Apr. 19, 2018

(87) PCT Pub. No.: WO2017/066820
PCT Pub. Date: Apr. 27, 2017

(65) Prior Publication Data

US 2018/0311556 A1 Nov. 1, 2018

(30) Foreign Application Priority Data

Oct. 20, 2015 (AU) ..... 2015904300

(51) Int. Cl.
*A63B 69/36* (2006.01)
*A63B 69/00* (2006.01)
*A63B 102/32* (2015.01)

(52) U.S. Cl.
CPC ..... *A63B 69/0059* (2013.01); *A63B 69/3623* (2013.01); *A63B 69/3608* (2013.01); *A63B 2102/32* (2015.10); *A63B 2225/09* (2013.01)

(58) Field of Classification Search
CPC ..... A63B 69/0059; A63B 69/3608
USPC ..... 473/212–215, 276
See application file for complete search history.

(56) References Cited

U.S. PATENT DOCUMENTS 2,498,006 A * 2/1950 Ridill ..... A63B 69/0059 434/252
3,680,869 A * 8/1972 Brady ..... A63B 69/0059 473/213
3,985,364 A * 10/1976 Brady ..... A63B 69/0059 473/213
4,895,373 A * 1/1990 Richmon ..... A63B 69/0059 473/215
5,188,365 A * 2/1993 Picard ..... A63B 69/0059 473/212
5,397,122 A * 3/1995 Herridge, II ..... A63B 21/0004 473/212

(Continued)

OTHER PUBLICATIONS

International Search Report dated Oct. 10, 2016 issued in PCT International Patent Application No. PCT/AU2016/000253, 3 pp.

*Primary Examiner* — Mark S Graham
(74) *Attorney, Agent, or Firm* — Nixon & Vanderhye P.C.

(57) ABSTRACT

A training aid for aiding a swing of a person at striking a ball such as in golf. The training includes a first arm cuff and at least one leg cuff with an intermediate connector having at least one resilient member. In this way the at least one resilient member extends in use between a trailing upper arm or above elbow of the player and the player's front lower torso or leading leg which in use aids the user by ensuring the large muscle of the trailing upper arm UA in a cocked elbow formation starts the down swing and aids the correct sequence of movement.

2 Claims, 15 Drawing Sheets

(56) References Cited

U.S. PATENT DOCUMENTS

| | | | | |
|---|---|---|---|---|
| 5,704,856 | A * | 1/1998 | Morse | A63B 21/0004 473/212 |
| 5,857,947 | A | 1/1999 | Dicker et al. | |
| 6,027,413 | A * | 2/2000 | Smith | A63B 69/0059 473/212 |
| 6,458,036 | B1 * | 10/2002 | Gutierrez | A63B 69/0059 473/207 |
| 7,172,522 | B1 * | 2/2007 | Harvey | A63B 69/0059 473/450 |
| 7,608,026 | B1 * | 10/2009 | Nicassio | A63B 21/00185 24/265 BC |
| 7,758,436 | B2 * | 7/2010 | Reynolds | A63B 69/0057 473/207 |
| 7,954,497 | B2 * | 6/2011 | Doroski | A61F 5/3715 128/878 |
| 2002/0193188 | A1 * | 12/2002 | Wah Loh | A63B 69/0059 473/458 |
| 2003/0178773 | A1 * | 9/2003 | Meyer | A63B 69/0059 273/276 |
| 2009/0227384 | A1 | 9/2009 | Reynolds | |
| 2010/0105531 | A1 | 4/2010 | Crawford | |

* cited by examiner

BALL STRIKING SWING TRAINING AID

This application is the U.S. national phase of International Application No. PCT/AU2016/000253 filed Jul. 15, 2016 which designated the U.S. and claims priority to Australian Patent Application No. 2015904300 filed Oct. 20, 2015, the entire contents of each of which are hereby incorporated by reference.

FIELD OF THE INVENTION

The present invention relates to a swing training aid and in particular to a training aid for practicing or improving a swing of a person at striking a ball.

The invention has been developed primarily for use in training a golf swing and will be described hereinafter with reference to this application. However, it will be appreciated that the invention is not limited to this particular use.

BACKGROUND OF THE INVENTION

Games of sport that require two handed striking of a ball are varied. However a particular category is identifiable and important in which the person remains substantially at a striking point and strikes a ball mounted or on the ground at that striking point.

In this category of games it is beneficial to identify the category in which the ball is stationary and the person is substantially stationary. In this category there is an element of a person's stance and swing that needs to be repeatable and controllable through multiple repetitions of different swings at different times and possibly at different locations to progress the sporting game. This is in distinction to flowing ball sports such as hockey where the player and ball are continuously moving and there is generally no fixed stationary stance ball striking.

This category of stationary ball and stationary ball striker games can include golf. In this game the golfer uses a club that is held by two hands and the club is swung to have a striking point at the club face on the head of the club at the distal end of club. The golfer needs to propel the golf club in a complex continuous arc in order to strike the ball mounted on a tee on the ground or a ball resting on the ground. This stance and swing needs to be repeatable and controllable through multiple repetitions of different swings to strike the golf ball at different times at different locations along the golf course to progress the sporting game.

In these instances, the club proceeds back to a backswing position and then the arms of the golfer are used to propel the club into the arc. The importance is to get timing of swing while also developing power and accuracy at hitting the ball in the required presentation. Therefore the user's forearm and upper arm muscles are important and the strength obtained from the player's upper body as well as the power from the lower body.

When variations of power and strength of striking are required there is the need for the player to be able to adapt. However there are some fundamentals that remain the same. If this is not done properly then the ball is mis-striked, mistimed and even missed. It definitely does not give a beneficial result.

Some of the fundamental issues are that players readily use:

the wrong stance;

the wrong muscles;

the wrong trajectory with the club in the backswing;

the wrong trajectory with the club in the forward swing; and the wrong presentation of the club head to the ball.

It can be considered that the golf swing comprises a stance, then a backswing to a cocked position with the club over the trailing shoulder, and then to proceed to a downward forward swing, a contact with the golf ball on the ground, and a follow through to the golf club over the leading shoulder. Each of these are connected and the aim is to provide a smooth simple continually repeatable stroke. This golf swing could be considered to be substantially circular but is more of an elliptical shape. Concentrating on one or two elements or parts of the golf swing can allow for the natural progression through all steps to improve the overall golf swing.

One factor to provide the improved golf swing is to maintain the lag in the forearm and golf clubs as the arms come down starting the down swing with the elbow to initiate the forward swing. If the forearms lead then the face of the golf club is likely to turn over and not provide a straight presentation. Depending on the timing and twist of your forearms will depend whether a cut or slice shot occurs, in which the non-orthogonal contact to the ball compared to the swing direction spins the ball left or right and creates the resulting curved ball path.

Another factor is to have a correct follow through after striking the ball.

One fault is to have a follow through in a "cricket stroke" arrangement, where the follow through is away from the body with the golf stroke curtailed at a forward extension. This is contrary to the good golf swing which is more of a continuous rotation across and within the body to result in the easy follow through over the leading shoulder.

It is also desirable to minimise tension in the hands and forearm. In most golfers, this is difficult to achieve as the golfer's instinct is to grip the golf club as hard as possible and to use their forearm to swing the golf club. This tension in the forearms means that the swing is being controlled by aggression and a cricket strikes approach and not by a smooth relaxed complete golf swing approach.

It can be seen that the training aids for golf have aimed at the provision of a means of continuous practice by the supply of a fixed or moving ball. None of these systems allows for the training and repetitiveness of the correct movement of the player to strike the ball.

It can be seen that there are a number of problems to be overcome including:

a. The need to keep forearms relaxed
b. The need to allow correct balance of energy and swing to the wrists holding the club compared to the arms
c. The need to engage the larger upper arm muscles
d. The need to correctly use the upper body
e. The need to move into the correct arc
f. The need to follow through the correct arc on a constant swing plane
g. The need to time the progress through the arc
h. The need to have the correct balance and timing of the power from the upper body and the power from the lower body
i. The need to exit the correct arc
j. The need to be able to adapt to create different powered shots or strikes
k. The need for the arc to be changed as needed
l. The need to realign with the new arc It can be seen that there are many factors to consider in having a good consistent golf swing which generates good club head speed and accurate presentation of the golf club head to the golf ball.

The present invention seeks to provide a training device, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to a first aspect, the invention provides a swing training aid comprising at least one elongated connector having at least one resilient member; and attachment means for attaching the elongated connector to a player such that the at least one resilient member provides in use a resilience between a trailing upper arm or elbow of the player and the player's lower torso or legs.

The invention also provides a method for training of ball striking skill from a stationary stance position comprising the steps of: providing a training aid with two cuffs connected by an elongated member therebetween having a resilient element; connecting the first cuff of the training aid to the arm around or adjacent the large muscle above the vertex of the elbow a mechanical aid to the trailing back leg of the person; connecting the second cuff of the training aid to the leading leg of the of the person; having the connecting elongated member fitted between trailing back arm of the person and the trailing back arm of the person; extending the stretchable band when the stretchable band is stretched and extended.

The present invention provides a swing training aid comprising at least one resilient member; and attachment means for attaching the at least one resilient member to a player such that the at least one resilient member extends in use between an upper arm or elbow of at least one of the player's arms and adjacent at least one of the player's hips or knees.

Advantageously, the player can train with resistance and for muscle memory.

Preferably, the attachment means comprises a first attachment means for attaching a first end portion of the at least one resilient member to the upper arm or elbow of at least one of the player's arms.

Preferably, the first attachment means is adapted to attach to the player's trailing arm.

Preferably, the first attachment means is adapted to attach to the player's elbow.

Preferably, the attachment means comprises a second attachment means for disposing a second end portion of the at least one resilient member at a point adjacent at least one of the player's hips or knees.

Most preferably the second attachment means is adapted to dispose the second end portion of the at least one resilient member at a point adjacent the player's knee on their leading leg.

Preferably, the second attachment means can be adapted to dispose the second end portion of the at least one resilient member at a point adjacent the player's trailing hip.

Preferably, the second attachment means is adapted to dispose the second end portion of the at least one resilient member at a point below the player's trailing hip.

Preferably, the second attachment means comprises a thigh band and/or a waist band to which the second end portion of the at least one resilient member is attached.

Preferably, the second attachment means is adapted to dispose the second end portion of the at least one resilient member initially from a point adjacent the player's trailing hip, and allowing the second end portion to travel generally toward the player's leading hip during the follow-through portion of a golf swing.

Preferably, the second attachment means is adapted to allow the second end portion to travel generally in a direction from a point below the player's trailing hip towards a point above the player's leading hip.

Preferably, the second attachment means is adapted to allow the second end portion to travel at a generally upward angle.

Preferably, the second attachment means comprises a rail extending generally from the player's trailing hip to the player's leading hip in use and a clip movable along the rail, wherein the second end of the at least one resilient member is attached to the clip.

Preferably, the rail extends generally from a point below the player's trailing hip to a point above the player's leading hip in use.

Preferably, the second attachment means comprises a harness for mounting the rail to the player in use, the harness comprising a thigh band to which a first end portion of the rail is attached and a waist band to which a second end portion of the rail is attached.

Preferably, the second attachment means comprises a harness for mounting the rail to the player in use, the harness comprising a thigh band, a waist band and a connecting band extending between the thigh band and the waist band, wherein a first end portion of the rail is attached to the connecting band and second end portion of the rail is attached to the waist band.

Preferably, position of attachment of the first end portion to the connecting band is selectively movable and lockable in position.

Preferably, the position of attachment of the second end portion to the waist band is selectively movable and lockable in position.

Preferably, the length of the connecting band is adjustable.

Preferably, the at least one resilient member comprises a flexible stretchable member.

Preferably, the length of the at least one resilient member is adjustable.

Preferably, the at least one resilient member comprises an elastomer material.

Preferably, the at least one resilient member comprises a rubber tube.

In an alternative embodiment, the second attachment means is adapted to dispose the second end portion of the at least one resilient member at a point adjacent the player's trailing knee.

Preferably, the second attachment means is a leg band to be attached to the player's trailing leg at the lower thigh portion, at the knee or just below the knee.

In another aspect, the present invention provides a golf swing training aid comprising an elbow brace, a leg band, and a resilient member for extending between the elbow brace and the leg band.

Preferably, the elbow brace is adapted to be attached to the player's trailing elbow.

Preferably, wherein the leg band is adapted to be attached to the player's trailing leg at the lower thigh portion, at the knee or just below the knee.

Preferably, the length of the resilient member between the elbow brace and the leg band is adjustable.

Preferably, the length of the resilient member between the first and second attachment means is adjustable.

The invention also provides a method for training of ball striking skill from a stationary stance position comprising the steps of: Providing a training aid with two cuffs connected by an elongated member therebetween having a resilient element; connecting the first cuff of the training aid to the arm around or adjacent the large muscle above the vertex of the elbow a mechanical aid to the trailing back leg of the person; connecting the second cuff of the training aid to the leading leg of the of the person; having the connecting elongated member fitted between trailing back arm of the person and the trailing back arm of the person; extending the stretchable band when the stretchable band is stretched and extended;

Also the invention provides a method of fitting a training aid for training of ball striking skill from a stationary stance position comprising the steps of: providing a training aid with two cuffs connected by an elongated member therebetween having a resilient element; connecting the first cuff of the training aid to the arm around or adjacent the large muscle above the vertex of the elbow; connecting the second cuff of the training aid to the leading leg of the of the person; having the connecting elongated member fitted between trailing back arm of the person and the trailing back arm of the person such that at fixed stationary position measure an adjust to freely extend from support leg to above elbow bend of trailing arm; adjusting the training aid to engage resilience when elbow bend passes upwardly from normal body hanging position to allow resilient extending of the stretchable band as the elbow bend passes to an upwardly from normal body backswing position; and selecting or adjusting the amount of resilience to match the physique and strength of the user.

There is also provided a method of using a training aid for training of ball striking skill from a stationary stance position comprising the steps of: providing a training aid with two cuffs connected by an elongated member therebetween having a resilient element; connecting the first cuff of the training aid to the arm around or adjacent the large muscle above the vertex of the elbow and connecting the second cuff of the training aid to the leading leg of the of the person so that the training aid is anchored between the two with a connecting elongated member therebetween and to provide resilience to above elbow bend of trailing arm; undertaking backswing with the training aid and engaging resilience when elbow bend passes upwardly from normal body hanging position to allow resilient extending of the stretchable band; begin downswing with resilience leading the arm and particularly the large arm muscle above the elbow bend to lead the trajectory; and follow through of the trajectory with resilience of first cuff on the user from the anchored second cuff on the forward leg of the user bringing elbow near the body; and follow through trajectory to complete playing the shot.

In one form the invention provides a golf swing training aid including at least one resilient member; and at least one attachment means for attaching the at least one resilient member to a golfer such that the at least one resilient member extends in use between a trailing upper arm or elbow of the golfer and the golfer's lower torso or legs.

In use this is aiding the use of the trailing forearm starting the down swing with the elbow to initiate the first part of the downward swing from the cocked backswing position from over the trailing shoulder, wherein the golf swing training aid can be substantially easily assembled and used with improved effectiveness including benefits of any one or more of the following:

a. improvements in structure and assembly including construction in order to provide a more easily designed and useable golf swing training aid;

b. Improvements in focus on particular parts of the golf swing to aid the complete golf swing;

c. Improvements in adjustability to provide a graduated approach that improves golf swing type, timing and power.

Other aspects of the invention are also disclosed.

BRIEF DESCRIPTION OF THE DRAWINGS

Notwithstanding any other forms which may fall within the scope of the present invention, preferred embodiments of the invention will now be described, by way of examples only, with reference to the accompanying drawings in which.

DESCRIPTION OF EMBODIMENTS

Figure 1:
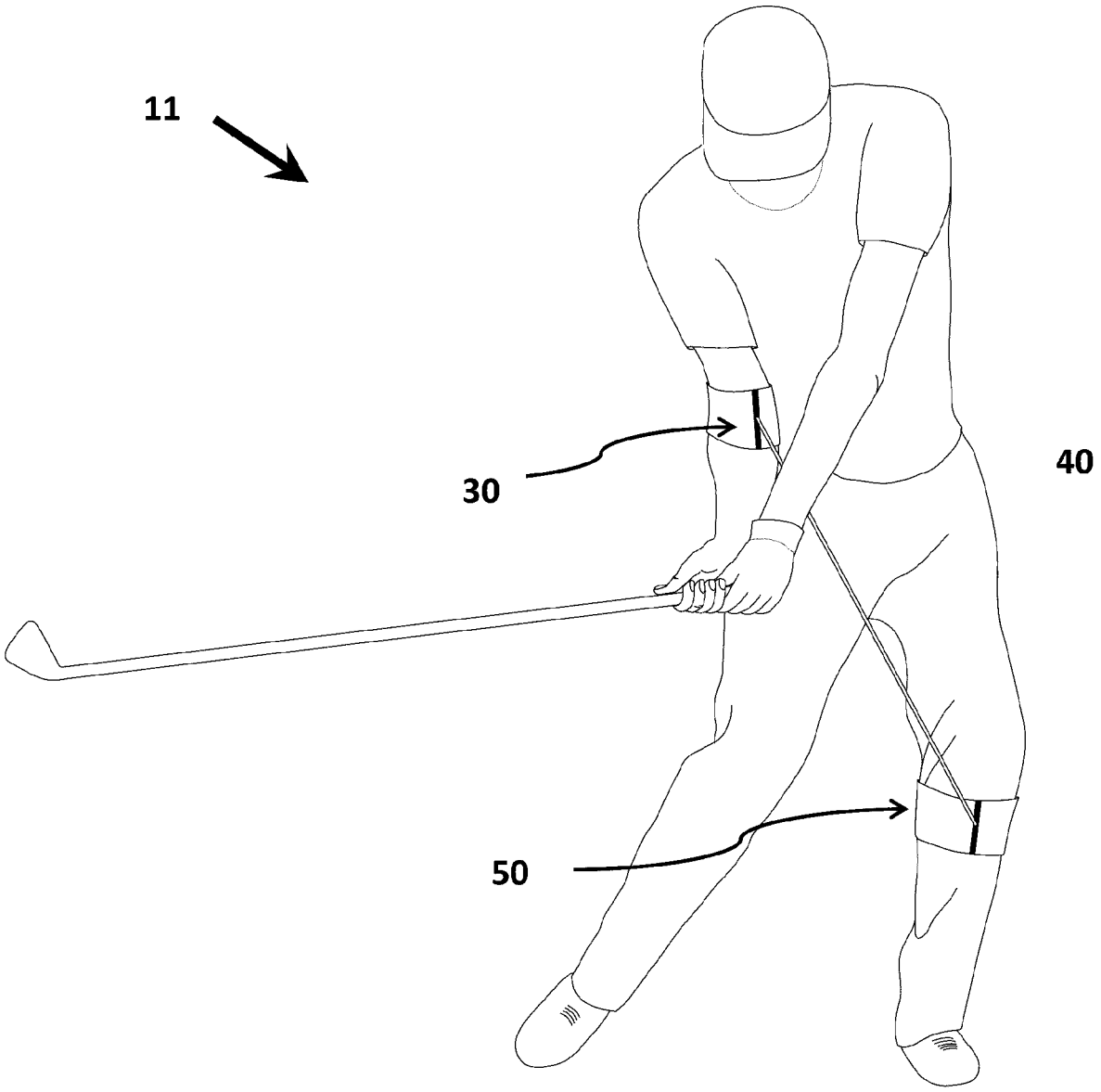
FIG. 1 is a schematic of view of a training aid in use in accordance with a preferred embodiment of the present invention attached to a right handed golfer, with the golfer in the middle stages of presenting the club to strike the ball from a backswing position.

It should be noted in the following description that like or the same reference numerals in different embodiments denote the same or similar features.

Fixed Version Training Aid

Figure 2:
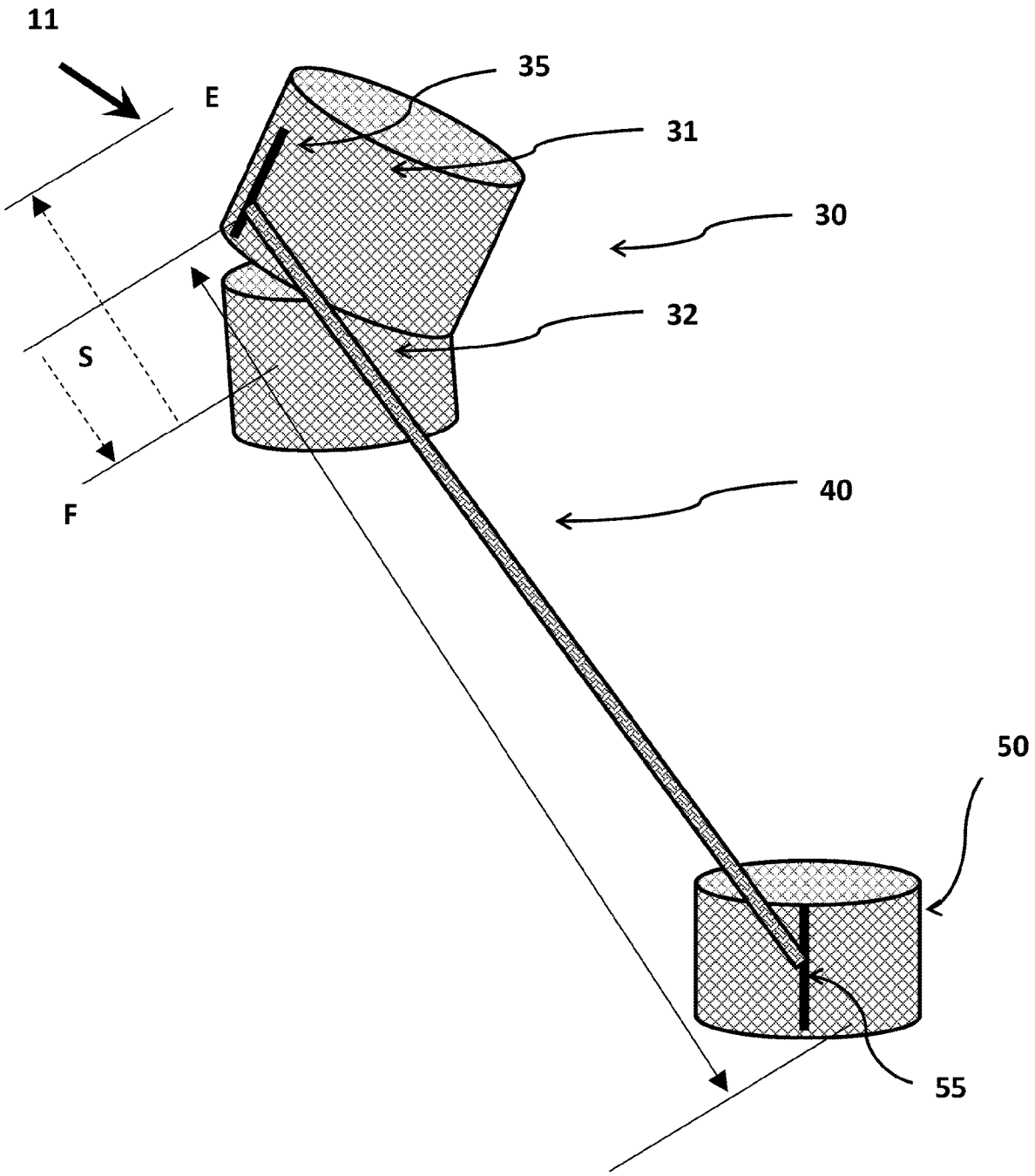
FIG. 2 is a diagrammatic view of a preferred embodiment of the present invention which is a fixed version such that the training aid has fixed mounting position in use on the trailing arm and leg of the user.

FIGS. 1 and 2 show a training aid 11 in accordance with a preferred embodiment of the present invention. The training aid 11 includes a first arm cuff 30 and at least one leg cuff 50 with an intermediate connector 40 having at least one resilient member.

In this way there is attachment means for attaching the training aid 11 to a player such that the intermediate connector 40 having at least one resilient member extends in use between a trailing upper arm or above elbow of the player and the player's front lower torso or leading leg.

In use this aids the user by ensuring the trailing upper arm UA starting the down swing with the elbow with elbow bend EB1 to EB2 in the first part of the downward swing from the cocked backswing position from over the trailing shoulder.

FIG. 2 shows a particular training aid 11 in accordance with a preferred embodiment of the present invention. The training aid 11 is a version which includes an elbow brace 30 formed of two cuffs 31 and 32 fitting of the upper arm UA and forearm FA on either side of the elbow EB. The use of two cuffs is preferable than a continuous single brace so as to prevent rolling of the material and uncomfortable to the user.

At the other end of the training aid 11 is a leg band 50 formed by another cuff that extends around the front leg of the player below the knee. A resilient member 40 extends between the elbow brace 30 and the leg band 50. The elbow brace 30, leg band 50, and resilient member 40 are made from similar materials as those of the training aid 10 above.

The UA cuff 31 can have a mount slide 35 for mounting the end of the resilient means. This is beneficial in three ways.

Firstly it ensures that the resilient force is applied to the large muscle of the upper arm UA of the trailing arm of the user in the golf swing.

Secondly it allows for slight movement of the mount to resist twisting of the resilient means 40. However the end of the resilient means 40 can be fixed to the cuff 31.

Thirdly it allows for disconnection and replacement of different resilient members 40 to change the resilience of the resilient member 40 to match the user's physiology, strength, and expertise.

Similarly the leg cuff 50 can have a mount slide 55 for mounting the end of the resilient means with similar benefits. However the end of the resilient means 40 can be fixed to the cuff 50.

In Use Extending Between Trailing Arm and Leading Leg

In use, the leg band 50 is attached around the golfer's trailing leg at the lower thigh portion, at the knee or just below the knee. The elbow brace 30 is then attached to the golfer's trailing (right) elbow 104.

Figure 3:
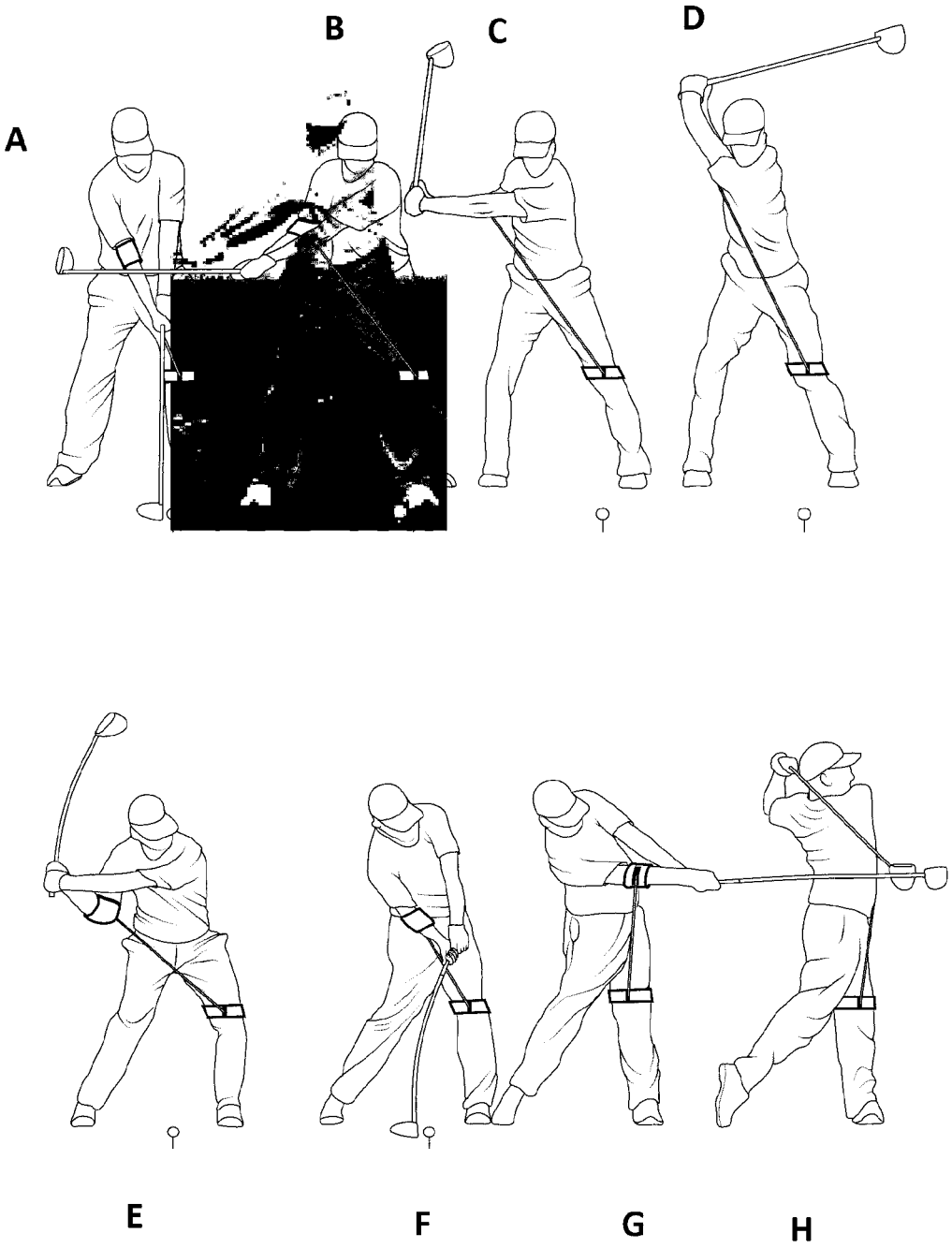
FIG. 3 shows 8 time elapsed front on diagrammatic views A, B, C, D, E, F, G and H of the use of the training aid of FIGS. 1 and 2 by a right handed golfer extending between trailing arm and leading leg.
Figure 4:
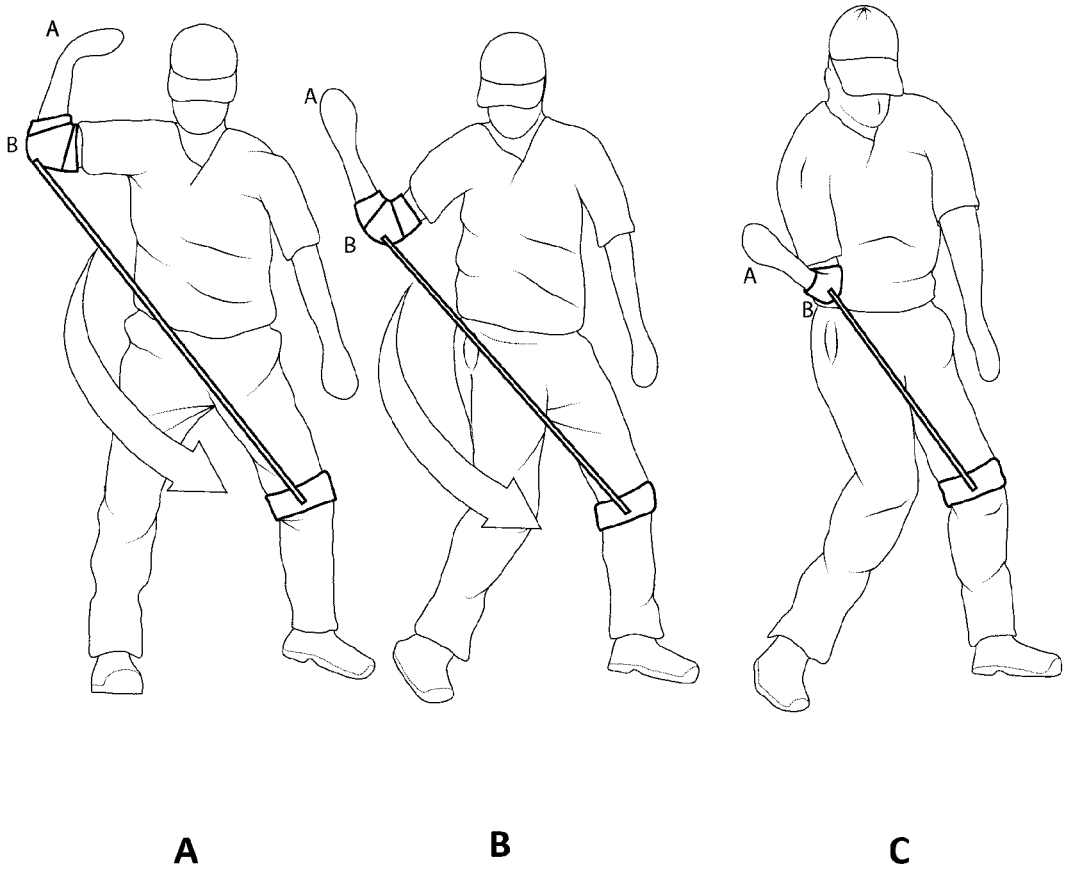
FIG. 4 shows 3 time elapsed diagrammatic views A, B, and C, of a the effect particularly on the trailing arm by the use of the training aid of FIGS. 1 and 2 on a right handed golfer extending between trailing arm and leading leg.

As shown in FIGS. 1 and 3, during the back swing, the resilient member 40 is stretched and the resilient member 40 applies a generally downward force as indicated by arrow 60 to the golfer's right elbow 104. This generally downward force 60 urges the golfer 100 to start using his/her bigger muscles in the shoulder and upper arm, rather than the forearm and hands. This also forces the golfer to reduce tension in his/her forearm and hands.

During the forward swing, the generally downward force 60 forces the golfer's right elbow 104 in a desired downward direction ahead of the forearm and wrist, as the user again is forced to use his/her shoulder and upper arm muscles rather than the forearm and hands. The reduced tension in the forearm and hands is also generally maintained.

The training aid 11 is thus a simple but effective aid and assists a golfer to train his/her golf swing. With the training aid, the golfer is forced to use his/her bigger shoulder and upper arm muscles with the forearm and hand muscle relaxed. The training aid also trains the golfer's muscles by simply letting the resilient member pull the golfer's trailing elbow down to the trailing hip and then through the ball.

As shown in FIG. 2 three important elements are:

a. The fitting of the cuff 31 to the arm to be effective at or above the elbow bend EB of the user and therefore applying the resilience to the large muscles of the upper arm UA rather than the forearm FA;
b. the adjustment of when the resilience of the resilience member 40 takes effect so that the resilience goes beyond a slack position F to a stretched minimum resilience S to an active extended resilient position E;
c. the adjustment of the amount of resilience of the resilient member 40 to match the user's physiology, strength, and expertise.

As shown in FIGS. 2, 3, 4 and 5 and FIGS. 12 and 13 three important resultant actions are:

a. by connection to the arm at or above the elbow EB the resilient member 40 initially acts on the large muscle of the upper arm UA rather than the muscles on the forearm FA;
b. the angle of the elbow bend EB can be consistent as shown as EB1 to EB2;
c. the swing is then made consistent in the swing plane SWP formed in the plane between SWP1 to SWP2.

Figure 5:
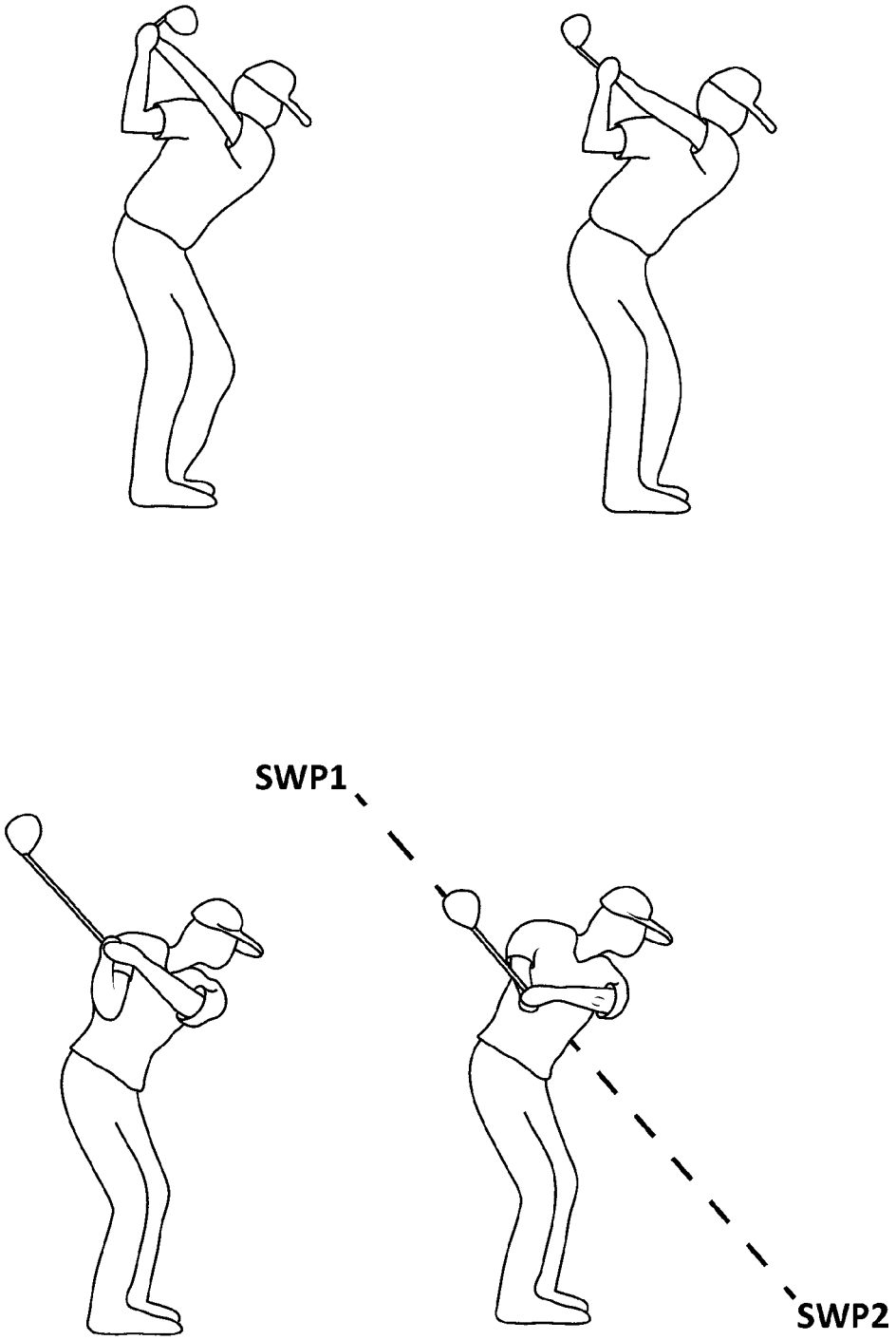
FIG. 5 shows four diagrammatic views 1, 2, 3 and 4 of a user of the training aid extending between trailing arm and leading leg showing from behind how the training aid ensures the effect on the user along a correct backswing set up to progress in the consistent swing plane of SWP1 to SWP2.

As shown in FIG. 5 using the training aid and letting the resilience pull your elbow down into/towards your hip, brings the club into the slot of the swing plane SP readying for your "soft" (not tense) hands/forearms to hit at the ball. If the sequence is undertaken correctly in the downswing, and the training aid urges you into that correct sequence, the club will effortlessly unfold from the top cocked backswing position to the ball hitting position and follow through.

Connection Between Trailing Leg and Trailing Arm

Figure 6:
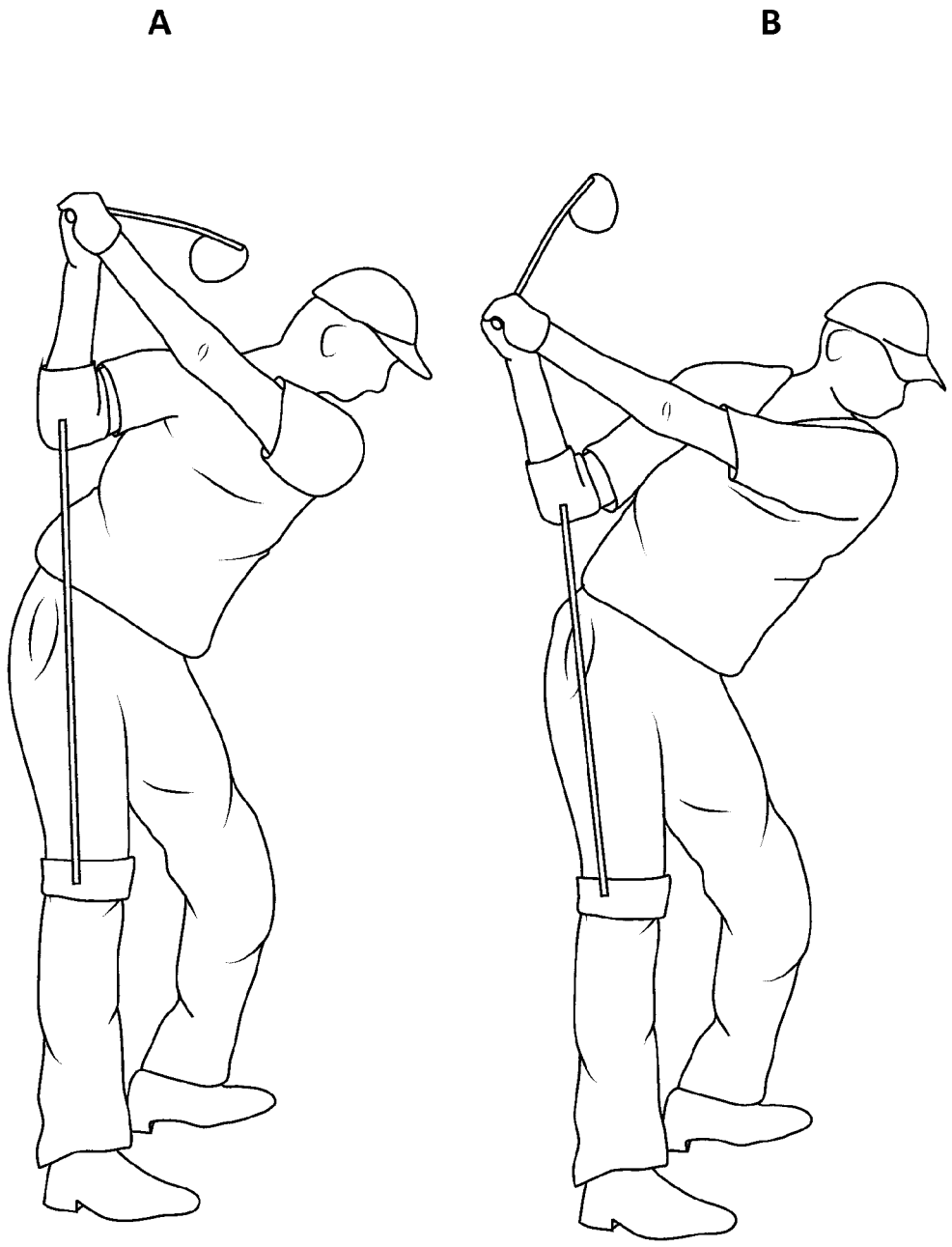
FIG. 6 shows two diagrammatic views A and B of a user of the training aid showing from behind how the training aid extending between trailing arm and trailing leg changes the effect on the user from the incorrect backswing set up B to the correct backswing setup A.
Figure 7:
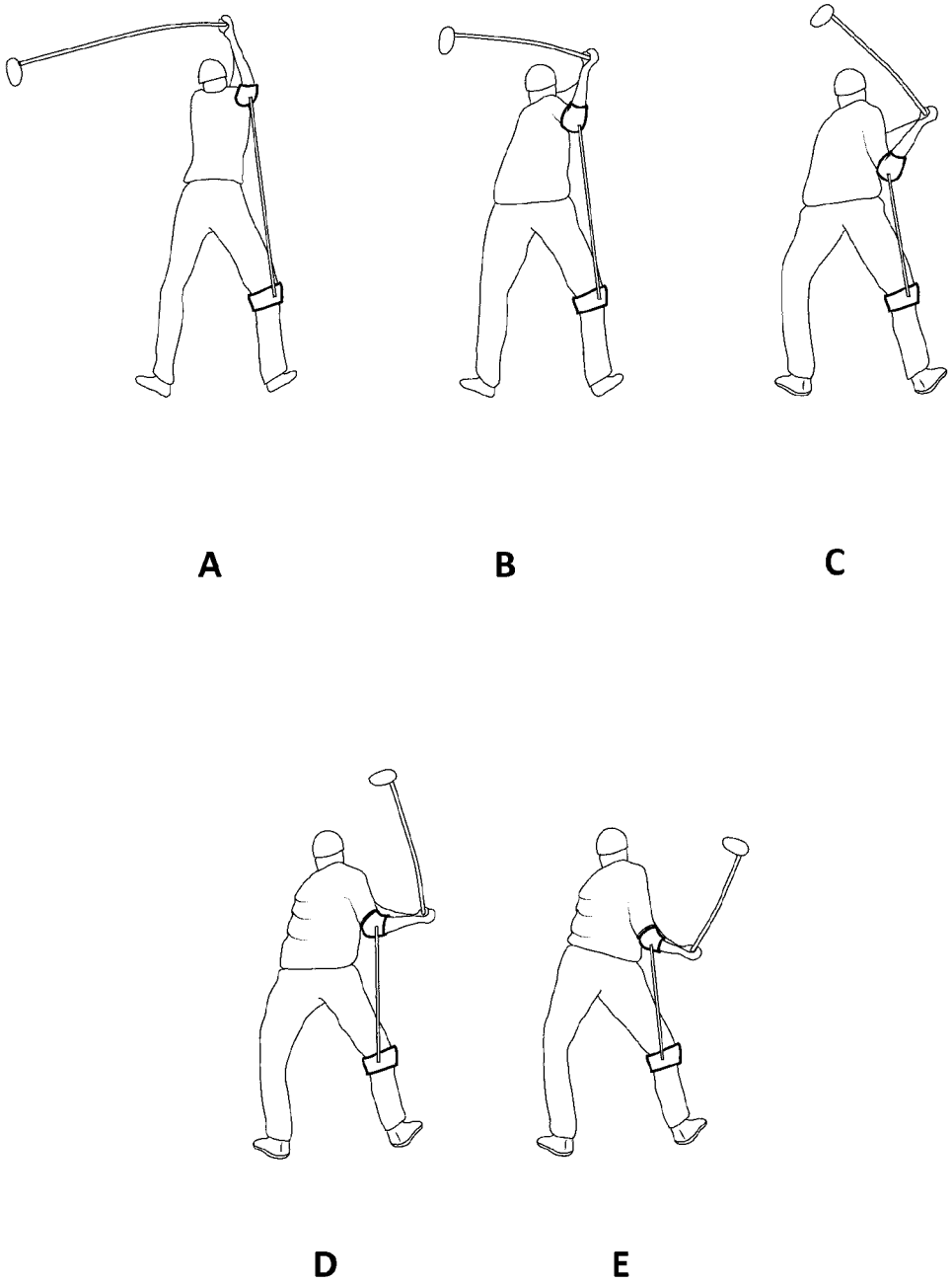
FIG. 7 shows 5 time elapsed diagrammatic views A, B, C, D and E, from behind the user of the use of the training aid of FIGS. 1 and 2 by a right handed golfer extending between trailing arm and trailing leg.

As shown in FIGS. 6 and 7 the device of a training aid can be extending between trailing arm and trailing leg in accordance with a preferred embodiment of the present invention attached to a right handed golfer. This creates most but not all of the advantages of the invention and therefore is not as preferred as training aid extending between trailing arm and leading leg.

Variable Slide Version

FIGS. 8 to 11 show a training aid 10 in accordance with a preferred embodiment of the present invention. This can be considered to be an interim device of a training aid on a slide mechanism extending between trailing arm and trailing leg but movable towards extending between trailing arm and leading leg in accordance with a preferred embodiment of the present invention attached to a right handed golfer.

The training aid 10 includes a rail 20, a slide clip 25 movable along the rail 20, an elbow brace 30, a resilient member 40 extending between the elbow brace 30 and the slide clip 25, and a harness 50 for maintaining the desired position and orientation of the rail 20 to the golfer.

The description below refers to a right handed golfer where the leading and trailing sides are the left and right sides respectively. For a left handed golfer, the sides are reversed and where the leading and trailing sides are the right and left sides respectively The rail 20 includes a trailing end 21 and a leading end 22. In the desired position and orientation of the rail 20, the trailing end 21 is positioned at a point below the golfer's trailing side hip (right hip), with the rail 20 extending at an upward angle to the leading end 22 which is positioned at a point above the golfer's leading side hip (left hip).

The harness 50 maintains the desired position and orientation of the rail 20, and includes a waist band 52, a thigh band 54, and a connecting band 56 which extends generally downwardly from the waist band 52 to the thigh band 54. The waist band 52 and thigh band 54 are both straps with joinable buckled ends, which allow their lengths to be adjusted as desired to loosen/tighten on the golfer. The connecting band 56 is also a strap fixed to portions of the waist band 52 and thigh band 54.

The rail 20 can also be made from a strap material, or it can be made from a rigid or semi rigid material, including a plastics or rubber rod/tube. The trailing end 21 is attached to the connecting band 56, between the waist band 52 to the thigh band 54. The leading end 22 is attached to the waist band 52 adjacent in use to the golfer's leading hip.

The slide clip 25 is movable along the rail 20. This slidable/movable movement can be made from any suitable arrangement between the slide clip 25 and the rail 20. For example, the slide clip 25 can simply be a ring through which the rail 20 extends through or the rail 20 can include a channel formation and the slide clip 25 can include a corresponding male formation for sliding along the channel formation.

The elbow brace 30 is adapted for attaching to the golfer's trailing elbow, which for the right handed golfer is the golfer's right hand. The elbow brace 30 can be a strap with hook and loop (e.g. VELCRO) ends or it can be a tubular brace through which the arm can be inserted to be located at the elbow. The elbow brace 30 can be made from a resiliently stretchable material for a tight fit at the elbow or it can include an adjustable fitting strap.

The resilient member 40 extends from the elbow brace 30 to the slide rail 25. The resilient member 40 in the embodiment is a stretchable (elastomer) rubber tube but can alternatively be made from other stretchable material. The resilient member 30 is removable from the elbow brace 30 and the slide rail 25 so that it can be replaced with another resilient member 30 with a different stretching properties, such as length or elastic strength.

Fixed Version in Comparison to Variable Slide Version

Instead of having a moving anchor point trying to operate on two sections of the golf swing there can be a single fixed anchor of the second attachment means for disposing a second end portion of the at least one resilient member at an anchor point being a point below the golfer's waist to provide a downward resilient action from the top of the swing.

The second attachment means for disposing a second end portion of the at least one resilient member can be at a point below the golfer's waist adjacent or below at least one of the golfer's hips or knees. Preferably the second end portion of the at least one resilient member at a point adjacent the golfer's trailing hip or knee.

The second attachment means can be a harness or a clothing item adapted to which the second end portion of the at least one resilient member is attached.

The attachment means for attaching the at least one resilient member to a golfer is so that the at least one resilient member extends in use between a trailing upper arm or elbow of the golfer and the golfer's lower torso or legs wherein in use aiding the use of the trailing forearm in the first part of the downward swing from the cocked backswing position from over the trailing shoulder.

Method of Use

Use of the training aid 11 will now be described. This method for training of ball striking skill from a stationary stance position comprising the steps of:

a) Providing a training aid with two cuffs connected by an elongated member therebetween having a resilient element;
b) connecting the first cuff of the training aid to the arm around or adjacent the large muscle above the vertex of the elbow a mechanical aid to the trailing back leg of the person;
c) connecting the second cuff of the training aid to the leading leg of the of the person;
d) having the connecting elongated member fitted between trailing back arm of the person and the trailing back arm of the person;
e) extending the stretchable band when the stretchable band is stretched and extended.

As a summary of general use of Option A the resilient member is to aid the first part of the downward swing from the cocked backswing position over the trailing shoulder.

The optional Option B is using the movable anchor along the slide and aids the follow through after contact with the ball towards a position with follow through swing position over the leading shoulder follow.

The optional option C is using a secondary connector to aid the follow through swing to be across and within the body to the over the leading shoulder follow through position.

| | Part of swing | Option A | Option B | Option C |
|---|---|---|---|---|
| Step 1 | a stance, | Resilient member is loose | Resilient member extends from anchor point | secondary connector is loose |

-continued

| | Part of swing | Option A | Option B | Option C |
|---|---|---|---|---|
| Step 2 | then a backswing to a cocked position with the club over the trailing shoulder, | Resilient member is stretch resiliently | Resilient member extends from anchor point | secondary connector is loose |
| Step 3 | and then to proceed to a downward forward swing starting the down swing with the elbow to initiate the forward swing, | Resilient member recoils aiding swing | Resilient member extends from anchor point | secondary connector starts to becomes effective |
| Step 4 | a contact with the golf ball on the ground, | Resilient member is loose | Resilient member extends from anchor point and moves along slide towards a leading leg position | secondary connector continues to becomes effective to continue swing across and within the body |
| Step 5 | and a follow through to the golf club over the leading shoulder | Resilient member is loose | Resilient member extends from anchor point along slide to a leading leg position | secondary connector is loose to allow finish of stroke |

Method of Use of Fixed Version

The waist band 52 is attached around the waist of a golfer 100 and the thigh band 54 is attached around the golfer's trailing (right) thigh 102. This locates the connecting band 56 generally down along the golfer's side. The elbow brace 30 is then attached to the golfer's trailing (right) elbow 104.

The method of using the training aid 11 for training of ball striking skill from a stationary stance position comprises the steps of providing and fitting the training aid by:

a. providing a training aid with two cuffs connected by an elongated member therebetween having a resilient element;
b. connecting the first cuff of the training aid to the arm around or adjacent the large muscle above the vertex of the elbow and
c. connecting the second cuff of the training aid to the leading leg of the of the person
d. so that the training aid is anchored between the two with a connecting elongated member therebetween and to provide resilience to above elbow bend of trailing arm.

Then in use, with reference to FIG. 3, and the 8 time elapsed front on diagrammatic views A, B, C, D, E, F, G and H, the right handed golfer with the training aid extending between trailing arm and leading leg undertakes the steps of:

a. backswing with the training aid and engaging resilience when elbow bend passes upwardly from normal body hanging position to allow resilient extending of the stretchable band;
b. begin downswing with resilience leading the arm and particularly the large arm muscle above the elbow bend to lead the trajectory; and
c. follow through of the trajectory with resilience of first cuff on the user from the anchored second cuff on the forward leg of the user bringing elbow near the body; and
d. final follow through trajectory to complete playing the shot.

Slide Version

Figure 8:
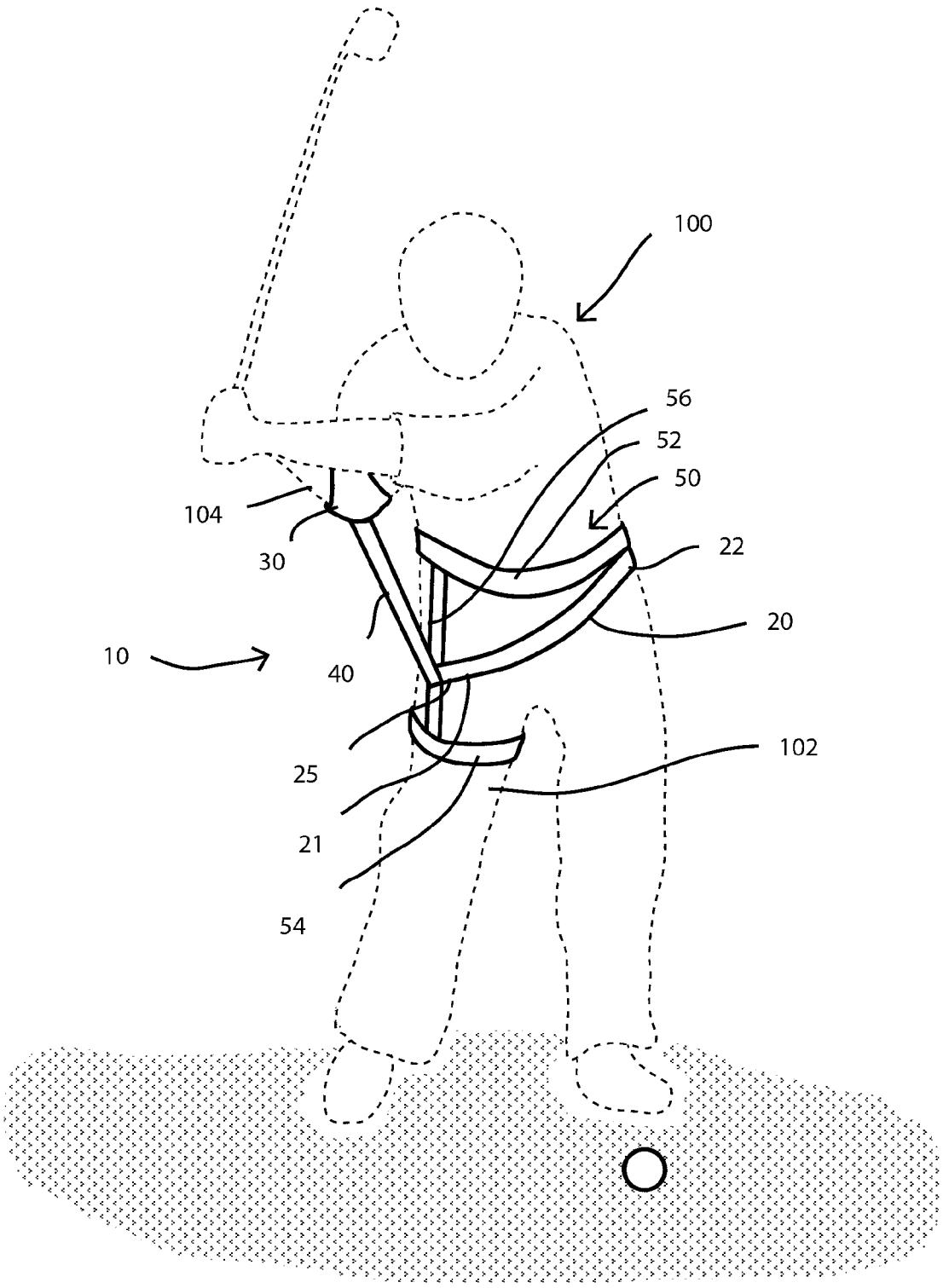
FIG. 8 is a schematic of view of a training aid on a slide mechanism extending between trailing arm and trailing leg but movable towards extending between trailing arm and leading leg in accordance with a preferred embodiment of the present invention attached to a right handed golfer, with the golfer in the initial stages of a backswing.

As shown in FIG. 8, in the initial stages of a back swing, the slide clip 25 is at the trailing end 21 of the rail 20, abutting the connecting band 56 and generally maintained therein by the resilient member 40 as the golfer's right elbow 103 moves backwards.

Figure 9:
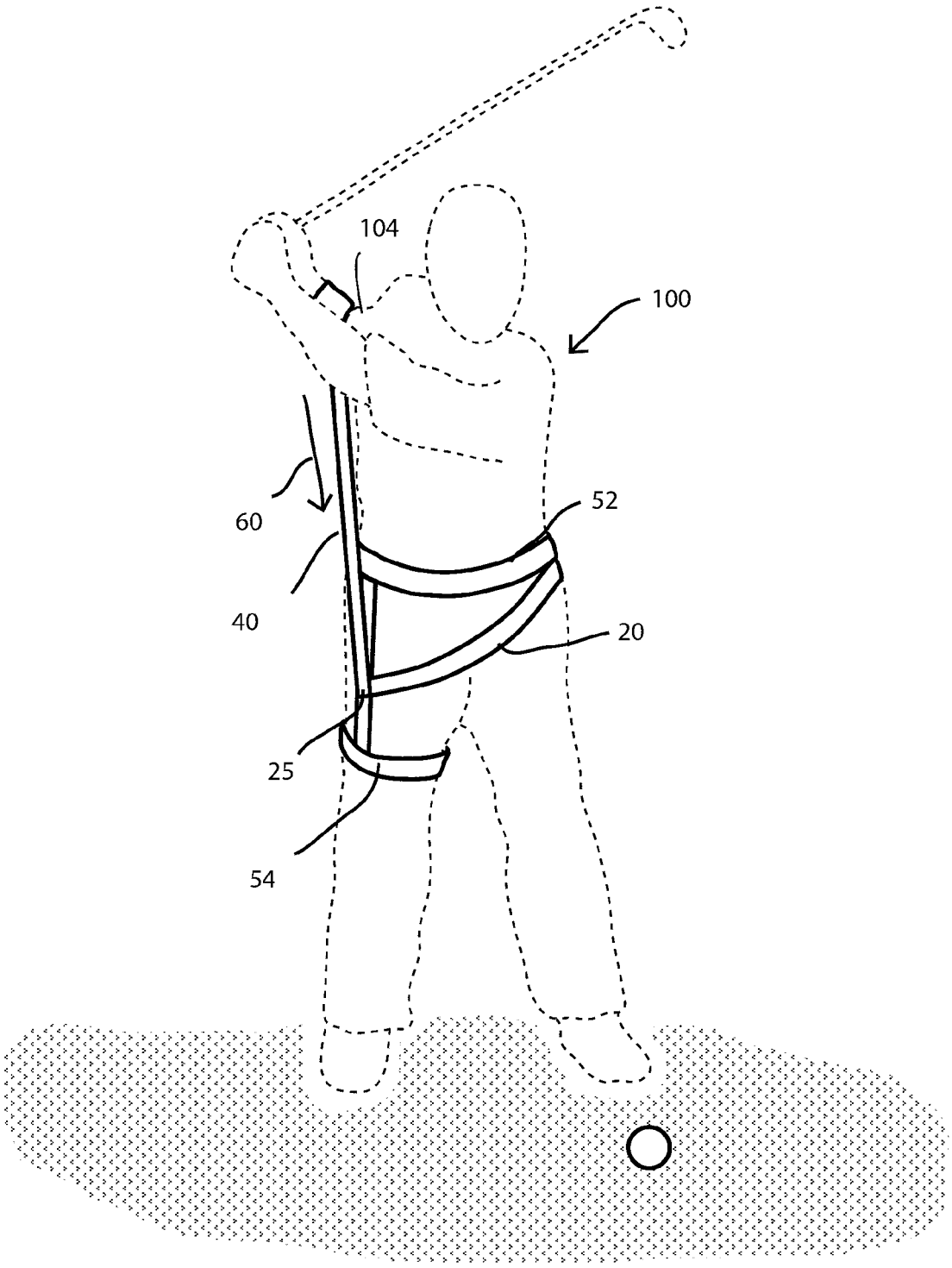
FIG. 9 shows the golfer near the end of the back swing of use of the training aid of FIG. 8.

As shown in FIG. 9, near the final stages of the back swing, the resilient member 40 is stretched and the resilient member 40 applies a generally downward force as indicated by arrow 60 to the golfer's right elbow 104. This generally downward force 60 forces the golfer 100 to start using his/her bigger muscles in the shoulder and upper arm, rather than the forearm and hands. This also forces the golfer to reduce tension in his/her forearm and hands.

Figure 10:
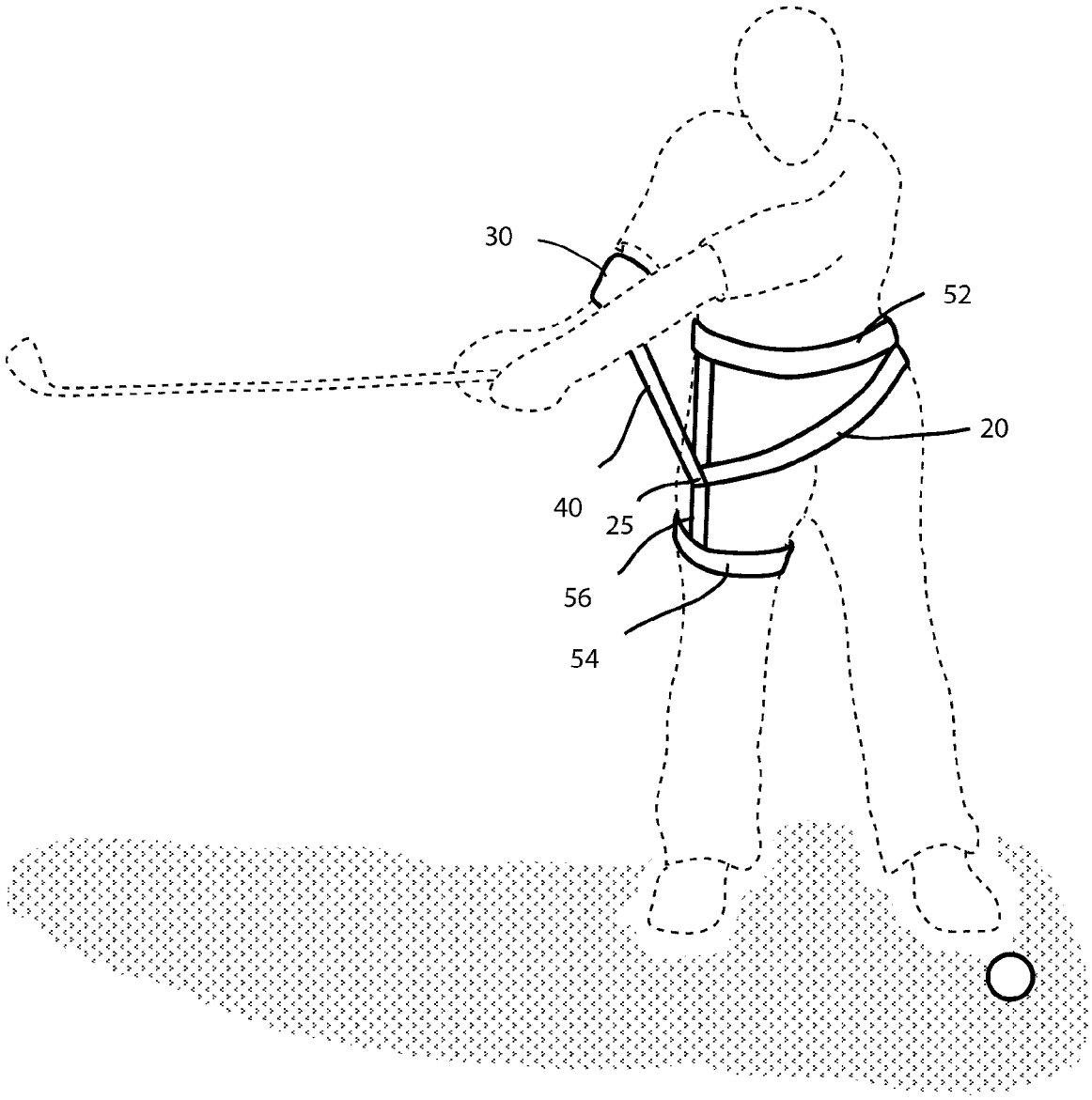
FIG. 10 shows the golfer around the half way portion of the forward swing of use of the training aid of FIG. 8.

As shown in FIG. 10, during the forward swing, the generally downward force 60 forces the golfer's right elbow 104 in a desired downward direction ahead of the forearm and wrist, as the user again is forced to use his/her shoulder and upper arm muscles rather than the forearm and hands. The reduced tension in the forearm and hands is also generally maintained.

Figure 11:
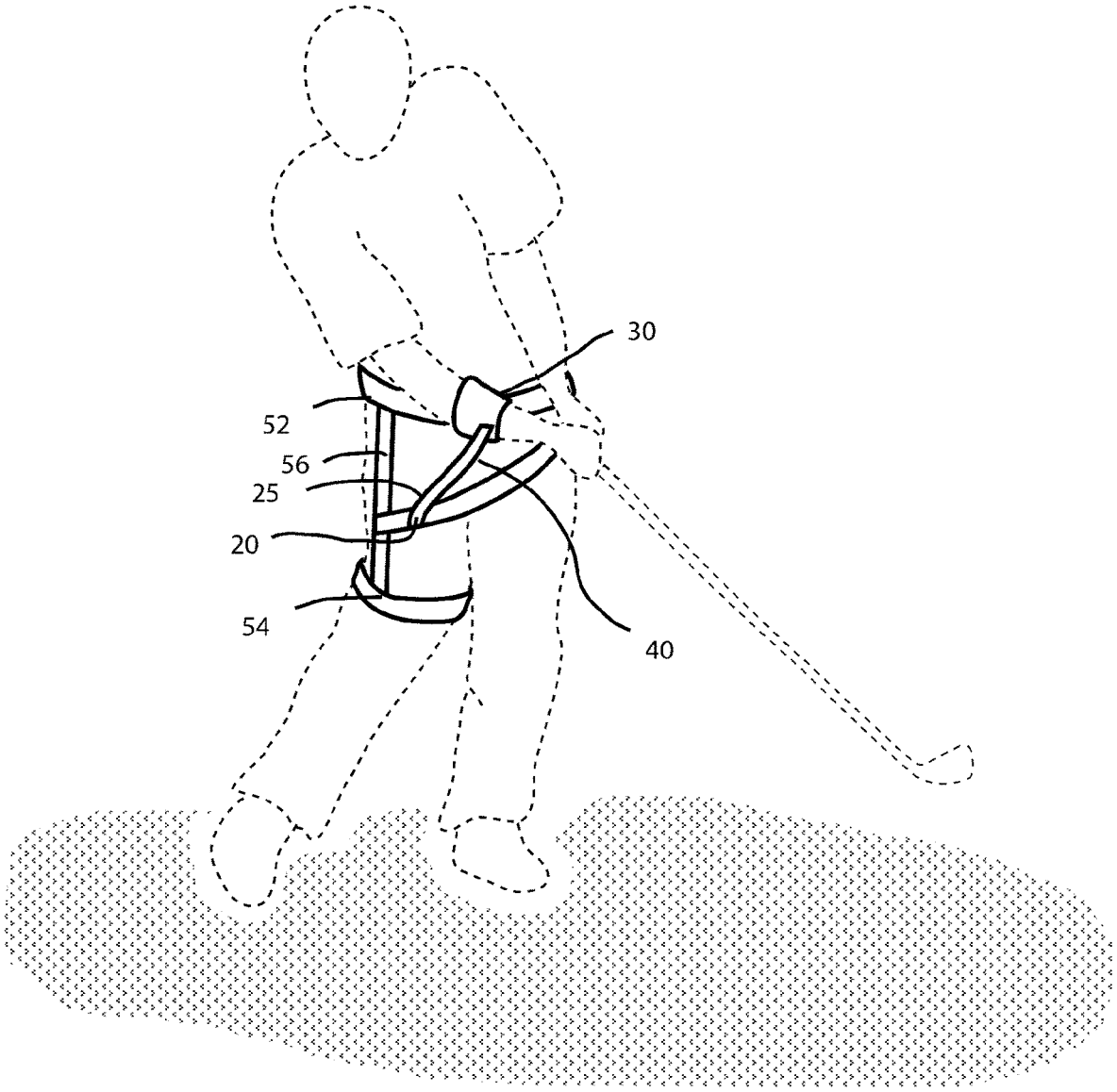
FIG. 11 shows the golfer during the follow through by the user of use of the training aid of FIG. 8.
Figure 12:
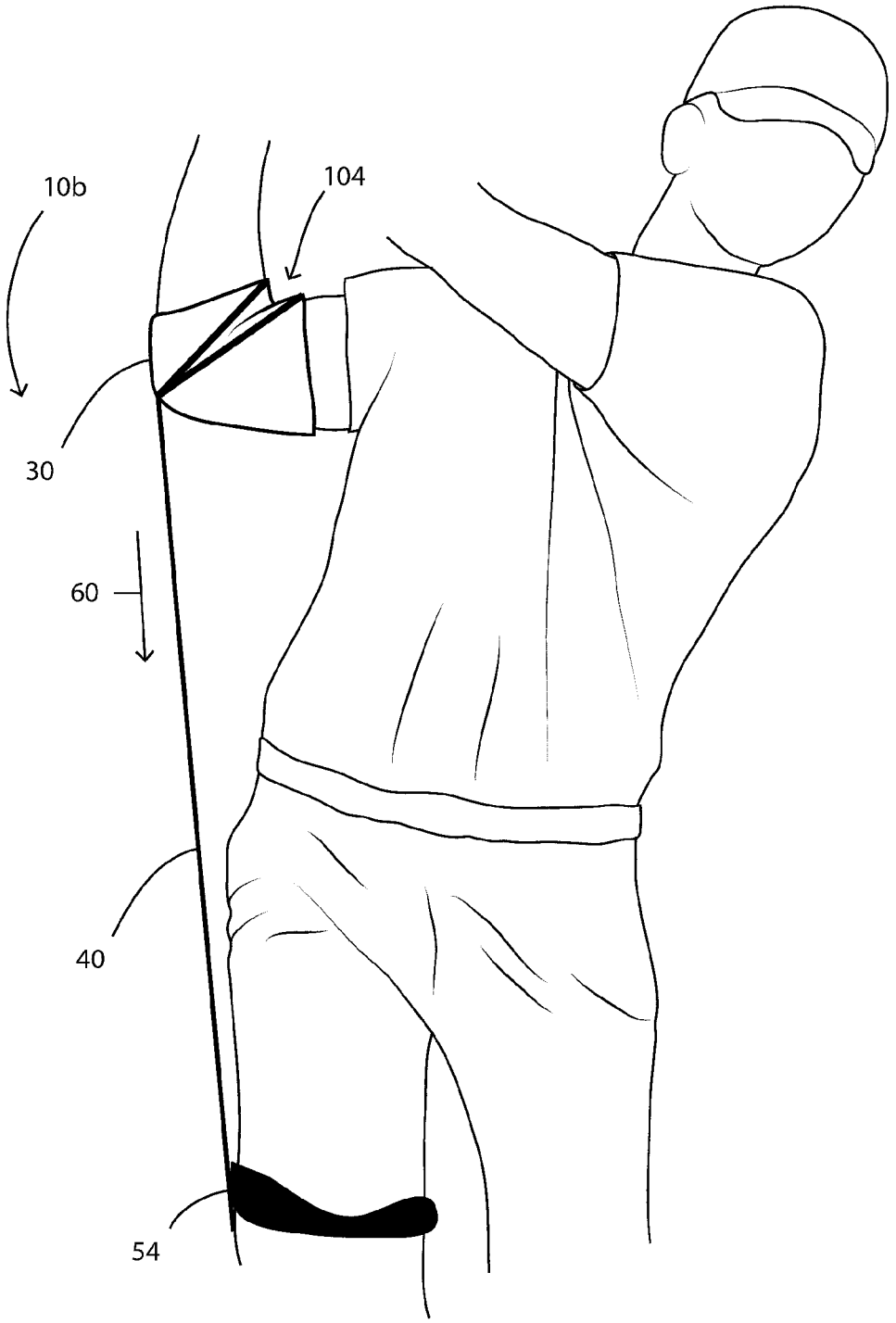
FIGS. 12 and 13 shows an elaboration of the operational position and connection to the arm around the elbow of embodiments of the present invention.

As shown in FIG. 11, during the follow through, the slide clip 25 travels along the rail 20, such that the golfer's arms are unimpeded in their movement.

The present training aid thus assists a golfer to train his/her golf swing. With the training aid, the golfer is forced to use his/her bigger shoulder and upper arm muscles with the forearm and hand muscle relaxed. The training aid also trains the golfer's muscles by simply letting the resilient member pull the golfer's trailing elbow down to the trailing hip and then through the ball. The golfer uses the training aid to strikes a selected number of practice balls (e.g. 10 to 100) and when the golfer removes the training aid to strikes more balls you, the golfer's whole body is more relaxed and follow through is improved to a full swing. With the training aid, the golfer can train his/her muscle memory and resistance training while striking golf balls.

It can be seen that numerous modifications can be made to the described embodiment. For example, the resilient member can comprise two or more resilient members to vary the elastic strength as required. The plural resilient members can be wound or braided with each other. The resilient member is also removable so that it can be replaced with light to hard tension resilient member as desired. The length of the resilient member is also preferably adjustable, for example by having the attachment of the elbow brace being selectively movable and lockable along the resilient member.

In a simple form of the invention, the resilient member can be attached to the thigh band or the waist band only and not movable along a rail. Such an embodiment would still provide training benefit. In other possible forms, the elbow brace may be attachable to the upper arm of the golfer's trailing arm, or the elbow/upper arm of the golfer's leading arm. Further alternatively, two elbow braces can be provided, one for each arm.

In another possible embodiment, the position of the trailing end of the rail along the connecting band can be made adjustable by having the trailing end attached to the connecting band via a clip which is selectively movable and lockable in position. The connecting band length can also be made adjustable. The position of attachment of the leading end of the rail to the waist band can also be made selectively movable and lockable in position in a similar manner.

In another possible embodiment, the rail can be attached to the thigh band rather than the connecting band. In another possible embodiment, the harness can include a second thigh band for the leading leg and a second connecting band extending from the waist band to the second thigh band. The rail can then extend between the two connecting bands with the attachment therebetween preferably selectively movable and lockable in position.

Fitting Requirements

Figure 13:
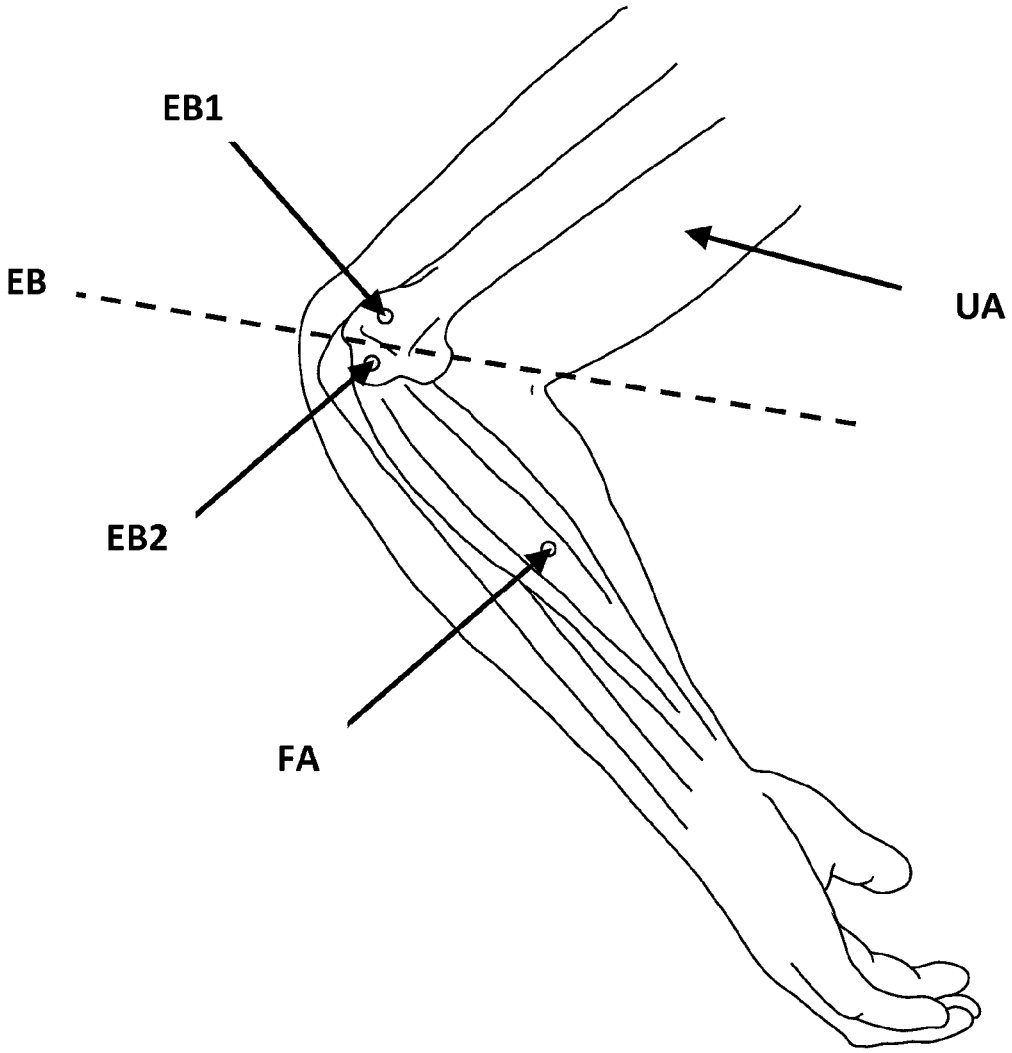

Referring to FIG. 2 there is shown the variability of fitting and referring to FIG. 13 there is shown a method 210 of undertaking this variability of fitting of the training aid for training of ball striking skill from a stationary stance position comprising the initial step 211 of providing a training aid 31 with two cuffs 30 and 50 connected by an elongated member 40 therebetween having a resilient element.

In step 212 it is needed for the training aid to be connected with the first cuff of the training aid to the arm around or adjacent the large muscle above the vertex of the elbow and connecting the second cuff of the training aid to the leading leg of the of the person. The training aid though in step 212 needs to have a length in the stationary position to be able to extend so there is minimal resilience when the user is in a presentation position. However as in step 213 the resilience must adjust so the connecting elongated member fitted between trailing back arm of the person and the trailing back arm of the person such that at fixed stationary position measure an adjust to freely extend from support leg to above elbow bend of trailing arm. This resistance can be adjusted so that the training aid engages active resilience when elbow bend passes upwardly from normal body hanging position to allow resilient extending of the stretchable band as the elbow bend passes to an upwardly from normal body backswing position.

A further step 214 can selecting or adjusting the amount of resilience to match the physique and strength of the user.

The characteristics of the components can include the following:

| Arm cuff 30 | Leg cuff 50 | Intermediate Connector 40 | Resilient Member 45 |
|---|---|---|---|
| Single over elbow bend | Single over elbow bend | All resilient member | Replaceable resilient member with different lengths |
| Double above and below elbow bend | Double above and below elbow bend | Partial non-resilient partial resilient member | Replaceable resilient member with different resilience |
| Adjustable fitting around arm | Adjustable fitting around arm | Adjustable non resilient | Adjustable length resilience member |
| Resilient fitting around arm | Resilient fitting around arm | Adjustable resilient | Adjustable resilience member |

Variable Resilience

In one form the training aid is an instructional aid such that the resilient member can have an initial touch resilience wherein the golfer feels the contact to the trailing forearm in the first part of the downward swing from the cocked backswing position from over the trailing shoulder.

In this way as the golfer goes through the motion of the golf swing and at the top of the back swing the golfer will feel a slight pressure on the trailing elbow or upper arm. This will not be sufficient to provide a physical effect but will be sufficient to concentrate the golfer's attention to the trailing elbow or upper arm and put the effort into that area as the golfer starts the forward motion of the golf swing. This will aid the golfer into a correct swing without tense or leading forearms.

However preferably the resilient member provides a resilient force strength which aids the golfer to start the golf swing with the trailing forearm in the first part of the downward swing from the cocked backswing position from over the trailing shoulder. This resilient force strength can be adjustable which aids the golfer to start the golf swing with the trailing forearm in the first part of the downward swing from the cocked backswing position from over the trailing shoulder. The resilient member can increase to an optimum resilient force strength which aids the user to maximise strength while maintaining a correct swing path and loose forearms in the initial stages of the backswing.

In this way as the golfer goes through the motion of the golf swing and at the top of the back swing the golfer will feel not only a slight pressure on the trailing elbow or upper arm but an active downward force. This is sufficient to provide a physical effect and will be sufficient to enforce the golfer's the trailing elbow or upper arm as the golfer starts the forward motion of the golf swing. This will aid the golfer into a correct swing without tense or leading forearms. However this force can be adjusted so as to increase the strength of the stroke.

The substantial benefit is that instead of a more aggressive stroke approach going incorrectly into strengthening the forearms and causing tension in the forearms resulting in a cricket bat strikes instead the energy and forced and controlled aggression goes into the upper arms at the start of the downward swing so that a correct and full swing provides the effective power stroke in a correct complete golf swing mode.

Resilience variation can be as per below:

| | |
|---|---|
| Junior players | 0.5 kg force to 1 kg force |
| Elite Junior players | 0.5 kg force to 1.5 kg force |
| Adult female players | 0.5 kg force to 1.5 kg force |
| Adult male players | 0.5 kg force to 2 kg force |
| Elite Adult female players | 0.5 kg force to 3 kg force |
| Elite Adult male players | 0.5 kg force to 5 kg force |

In Use

Figure 14:
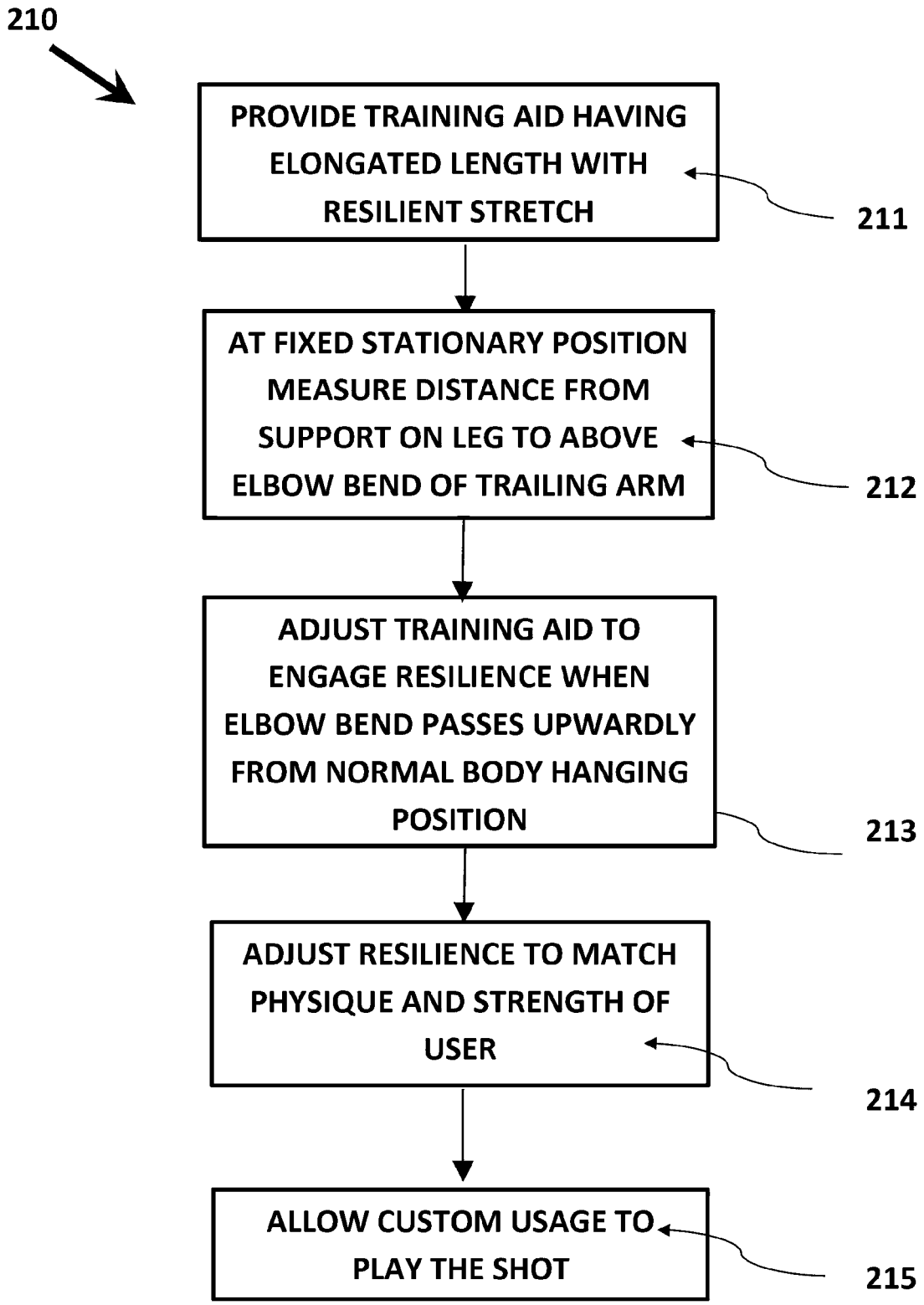
FIG. 14 is a schematic flow diagram of a method of fitting a training aid for training of ball striking skill from a stationary stance in accordance with a preferred embodiment of the present invention.
Figure 15:
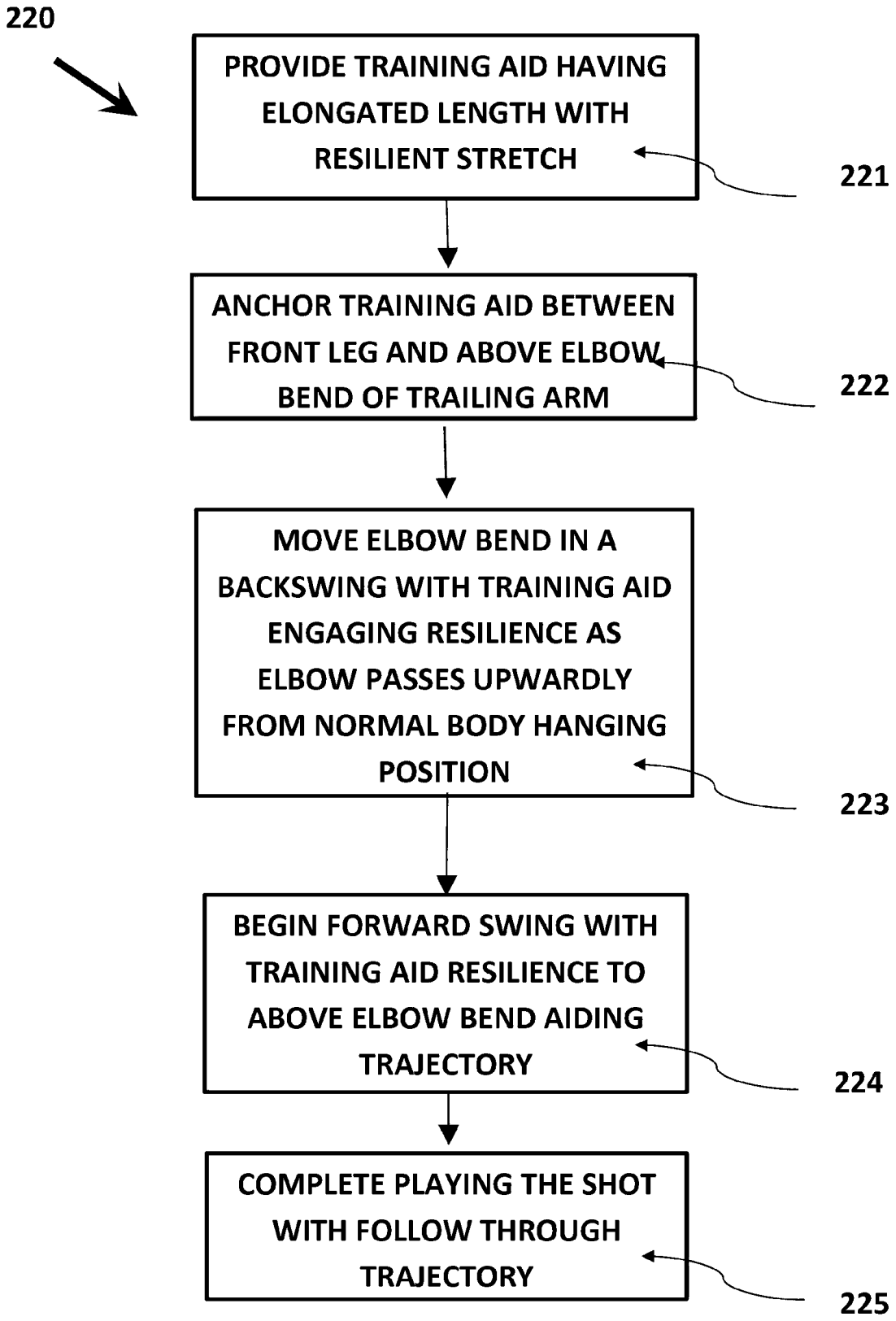
FIG. 15 is a schematic flow diagram of a method of using a training aid for ball striking the ball from a stationary stance in accordance with a preferred embodiment of the present invention.

Referring to FIG. 14 there is shown a method 220, of using a training aid for training of ball striking skill from a stationary stance position.

In step 221 there is the provision of a training aid with two cuffs connected by an elongated member therebetween having a resilient element.

Then in step 222 connect the first cuff of the training aid to the arm around or adjacent the large muscle above the vertex of the elbow and connecting the second cuff of the training aid to the leading leg of the of the person so that the training aid is anchored between the two with a connecting elongated member therebetween and to provide resilience to above elbow bend of trailing arm.

It is then possible with the training aid connected to proceed to step 223 of undertaking backswing with the training aid engaging resilience when elbow bend passes upwardly from normal body hanging position to allow resilient extending of the stretchable band. From this primed cocked backswing position the user can undertake the step 224 of beginning downswing with resilience leading the arm and particularly the large arm muscle above the elbow bend to lead the trajectory.

Then the player can follow through of the trajectory in step 225 with resilience of first cuff on the user from the anchored second cuff on the forward leg of the user bringing elbow near the body and follow through trajectory to complete playing the shot.

Thereby and referring to FIG. 3 in the 8 time elapsed front on diagrammatic views A, B, C, D, E, F, G and H the user being a right handed golfer

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the sports and training industries.

The claims defining the invention are as follows:

1. A method for training of ball striking skill from a stationary stance position comprising the steps of:

a. providing a training aid with two cuffs connected by an elongated connector member therebetween having a resilient element;

b. connecting the first cuff of the training aid to the arm around or adjacent the large muscle above the vertex of the elbow to allow leading by the elbow;

c. connecting the second cuff of the training aid to the leading leg of the player;

d. having the elongated connector member extending directly between the trailing upper arm of the player and the player's leading lower torso or leg;

e. undertaking a backswing with the training aid and engaging resilience when elbow bend passes upwardly from normal body hanging position to allow resilient extending of the resilient element;

f. beginning a downswing with resilience leading the arm and particularly the large arm muscle above the elbow bend to lead a trajectory;

g. following through of the trajectory with resilience of the first cuff on the player from the anchored second cuff on the forward leg of the player bringing the player's elbow near the body; and h. following through the trajectory to complete playing the shot, wherein the at least one resilient member provides in use a resilience directly between the trailing upper arm of the player and the player's lower torso or legs to maintain a lag in the forearm and golf club as the arms come down by starting an arcuate down swing with the elbow to initiate a forward swing and the resilience on the player trailing upper arm from the forward leg of the player providing follow through of the trajectory by bringing the elbow near and across the player's body.

2. A method of fitting a training aid for training of ball striking skill from a stationary stance position comprising the steps of:

a. providing a training aid with two cuffs connected by an elongated member therebetween having a resilient element;

b. connecting the first cuff of the training aid to the arm around or adjacent the large muscle above the vertex of the elbow;

c. connecting the second cuff of the training aid to the leading leg of the player;

d. having the connecting elongated member fitted between trailing back arm of the player and the leading leg of the player such that at fixed stationary position it can be measured and adjusted to freely extend from leading leg to above elbow bend of trailing arm;

e. adjusting the training aid to engage resilience when elbow bend passes upwardly from normal body hanging position to allow resilient extending of the stretchable band as the elbow bend passes to an upwardly from normal body backswing position; and f. selecting or adjusting the amount of resilience to match the physique and strength of the player, wherein the at least one resilient member provides in use a resilience directly between the trailing upper arm of the player and the player's lower torso or legs to maintain a lag in the forearm and golf club as the arms come down by starting an arcuate down swing with the elbow to initiate a forward swing and the resilience on the player trailing upper arm from the forward leg of the player providing follow through of a trajectory by bringing the elbow near and across the player's body;

g. wherein the connecting of the first cuff of the training aid to the arm around or adjacent the large muscle above the vertex of the elbow and connecting the second cuff of the training aid to the leading leg of the of the player so that the training aid is anchored between the two with the connecting elongated member therebetween and to provide resilience to above elbow bend of trailing arm allows g1 undertaking a backswing with the training aid and engaging resilience when elbow bend passes upwardly from normal body hanging position to allow resilient extending of the stretchable band;

g2 beginning the downswing with resilience leading the arm and particularly the large arm muscle above the elbow bend to lead the trajectory; and g3 follow through of the trajectory with resilience of first cuff on the player from the anchored second cuff on the forward leg of the player bringing the elbow near the body; and g4 follow through trajectory to complete playing the shot.

* * * * *